US011453040B2

(12) United States Patent
Yoshida et al.

(10) Patent No.: US 11,453,040 B2
(45) Date of Patent: Sep. 27, 2022

(54) BINDING MACHINE

(71) Applicant: MAX CO., LTD., Tokyo (JP)

(72) Inventors: Yusuke Yoshida, Tokyo (JP); Hiroki Ishiguro, Tokyo (JP); Terufumi Hamano, Tokyo (JP); Akira Kasahara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 91 days.

(21) Appl. No.: 16/788,779

(22) Filed: Feb. 12, 2020

(65) Prior Publication Data

US 2020/0254508 A1 Aug. 13, 2020

(30) Foreign Application Priority Data

Feb. 13, 2019 (JP) ..... JP2019-023659

(51) Int. Cl.

| | |
|---|---|
| ***B21F 15/04*** | (2006.01) |
| ***B21F 7/00*** | (2006.01) |
| ***B65B 13/28*** | (2006.01) |
| ***E04G 21/12*** | (2006.01) |

(52) U.S. Cl.

CPC ..... *B21F 15/04* (2013.01); *B21F 7/00* (2013.01); *B65B 13/285* (2013.01); *E04G 21/123* (2013.01)

(58) Field of Classification Search

CPC ..... B65B 13/04; B65B 13/18

See application file for complete search history.

(56) References Cited

U.S. PATENT DOCUMENTS 4,475,652 A * 10/1984 Heard ..... B65H 75/16 206/303
5,983,473 A * 11/1999 Yuguchi ..... E04G 21/122 29/33 F (Continued)

FOREIGN PATENT DOCUMENTS

EP 2123846 A1 11/2009
EP 3327223 A1 5/2018

(Continued)

OTHER PUBLICATIONS

The Extended European Search Report mailed in corresponding EP Patent Application No. 20157167.6 dated Jun. 17, 2020 (7 pages).

*Primary Examiner* — Adam J Eiseman
*Assistant Examiner* — P Derek Pressley
(74) *Attorney, Agent, or Firm* — Weihrouch IP

(57) ABSTRACT

A binding machine includes: an accommodation portion accommodating a reel around which a wire is wound; a wire feeding portion configured to feed the wire in a forward direction, winds the wire around a binding object, feeds the wire in a reverse direction, and wraps the wire around the binding object; and a torsion portion that twists the wire. The accommodation portion accommodates the reel such that the reel is offset in one direction along an axial direction of the reel with respect to the wire feeding portion. The binding machine further includes a restricting portion, in a wire passage between the reel and the wire feeding portion, which protrudes inward of the accommodation portion and has a restricting surface with which the wire bent in the other direction along the axial direction of the reel between the reel and the wire feeding portion comes in contact.

8 Claims, 10 Drawing Sheets

(56) References Cited

U.S. PATENT DOCUMENTS

| | | | | |
|---|---|---|---|---|
| 2005/0061389 | A1* | 3/2005 | Nakagawa | E04G 21/123<br>140/119 |
| 2018/0155940 | A1 | 6/2018 | Nagaoka et al. | |
| 2018/0207709 | A1* | 7/2018 | Kasahara | E04G 21/123 |

FOREIGN PATENT DOCUMENTS

| | | | | |
|---|---|---|---|---|
| JP | WO2017/014276 | A1 * | 1/2017 | |
| JP | 2017-25700 | A | 2/2017 | |
| WO | 2017/014280 | A1 | 1/2017 | |
| WO | WO-2017014176 | A1 * | 1/2017 | C12N 15/815 |

* cited by examiner

BINDING MACHINE

CROSS-REFERENCE TO RELATED APPLICATIONS

This application is based on and claims priority under 35 USC 119 from Japanese Patent Application No. 2019-023659 filed on Feb. 13, 2019.

TECHNICAL FIELD

The present invention relates to a binding machine which binds a binding object such as a reinforcing bar with a wire.

BACKGROUND ART

In recent years, there has been proposed a binding machine called a reinforcing bar binding machine which winds a wire around two or more reinforcing bars, twists the wound wire, and binds the two or more reinforcing bars.

The reinforcing bar binding machine of the related art has a configuration in which a wire is fed by a wire feeding portion and wound around the reinforcing bar, and then the wire is twisted and bound. With respect to such a reinforcing bar binding machine, there has been proposed a reinforcing bar binding machine in which, after winding the wire around the reinforcing bar, the wire is wrapped in close contact with the bar and cut, and then a point where one end portion side of the wire and the other end portion side intersect is twisted to bind the reinforcing bar.

The wire is fed in a reverse direction by the wire feeding portion to pull back the wire wound around the reinforcing bar and wrap it around the reinforcing bar. When the wire is fed in the reverse direction, the wire wound around the reel bends. Further feeding movement of the wire in the reverse direction causes the bent wire to move laterally along an axial direction of the reel. The lateral movement of the wire becomes more pronounced as the reel is offset to one side in a left-right direction with respect to the wire feeding portion. When the wire is fed in the reverse direction by the wire feeding portion, the wire will be oriented in an offset direction of the reel. Therefore, a technique has been proposed in which a restricting portion formed of a convex portion for restricting the movement of the wire is provided in an inner wall portion on an offset side of the reel (for example, see WO 2017/014280).

In addition, a technique has been proposed that includes means for restricting a wire between the reel and the wire feeding portion from coming off an input route to the wire feeding portion in an operation of feeding the wire in the reverse direction (for example, see JP-A-2017-25700).

In the binding machine, a space is provided between the reel and the wire feeding portion for loading the wire into the wire feeding portion and the wire can move in the axial direction of the reel between the reel and the wire feeding portion. In an operation of feeding the wire in the reverse direction, when the bent wire moves laterally in an offset direction of the reel along the axial direction of the reel, a force which bends the wire in an opposite direction to the offset direction of the reel is applied in a portion between the reel and the wire feeding portion. When the amount of bending of the wire of the portion between the reel and the wire feeding portion increases, a so-called buckling state in which the wires are bent occurs. This causes the wires to easily become entangled with each other. As a result, it leads to a wire feeding failure and to reloading of the reel after removing the unusable wire. Also, when the amount of bending of the wire increases, the wire easily comes off the reel from the flange portion of the reel.

SUMMARY OF INVENTION

In order to solve such a problem, an aspect of the invention provides a binding machine capable of suppressing the amount of bending of a wire.

In order to solve such a problem, an embodiment of the present invention provides a binding machine, which includes:

an accommodation portion accommodating a reel around which a wire is wound;

a wire feeding portion configured to feed the wire wound around the reel in a forward direction, winds the wire around a binding object, feeds the wire wound around the binding object in a reverse direction, and wraps the wire around the binding object; and a torsion portion configured to twist the wire, in which the accommodation portion accommodates the reel in such a manner that the reel is offset in one direction along an axial direction of the reel rotated by the wire being fed with respect to the wire feeding portion, and further comprising a restricting portion, in a wire passage between the reel accommodated in the accommodation portion and the wire feeding portion, which protrudes inward of the accommodation portion and has a restricting surface with which the wire bent in the other direction along the axial direction of the reel between the reel and the wire feeding portion comes in contact.

In the movement of feeding the wire in the reverse direction, the wire wound around the reel bends. Further feeding movement of the wire in the reverse direction causes the bent wire to move along the axial direction of the reel to the side where the reel is offset. Further feeding movement of the wire in the reverse direction causes the wire between the reel and the wire feeding portion to be bent in the other direction along the axial direction of the reel, to the opposite side to the side where the reel is offset. On the opposite side to the side where the reel is offset, the wire bent in the other direction along the axial direction of the reel comes into contact with the restricting portion which protrudes inward in the accommodation portion and in the offset direction of the reel, in such a manner that the force which bends the wire to the opposite side in the offset direction of the reel is received by the restricting portion between the reel and the wire feeding portion.

According to the above embodiment of the present invention, in the movement of feeding the wire in the reverse direction, when a force which bends the wire between the reel and the wire feeding portion is applied, this force is received by the restricting portion between the reel and the wire feeding portion, which makes it difficult for the wire to bend. Therefore, the amount of bending of the wire in the wire passage is reduced, it is possible to prevent the wires from becoming entangled with each other, and thus it is possible to suppress the occurrence of wire feeding failure. In addition, the wire is prevented from coming off the reel from the flange portion of the reel.

DESCRIPTION OF EMBODIMENTS

Hereinafter, an embodiment of a binding machine of the invention will be described. FIGS. 1 to 10 are for explaining the embodiment.

<Configuration>

Hereinafter, the configuration will be described. As illustrated in a side view of FIG. 1 and a front view of FIG. 2, for example, a reinforcing bar binding machine (binding machine) 1A is used to bind a binding object (hereinafter referred to as a reinforcing bar S) such as a reinforcing bar or an electric wire at a building site. This reinforcing bar binding machine 1A feeds a wire W in a forward direction indicated by an arrow F, curls the wire W while giving it an arc-shaped bending habit, and forms a loop Ru surrounding the reinforcing bar S. Next, in order to pull back the wire W, the wire W is sent in a reverse direction indicated by an arrow R and the wire W on which the loop Ru is formed is wrapped around the reinforcing bar S, and then the wire W is cut. Next, the reinforcing bar S can be bound by twisting the wire W.

Hereinafter, the reinforcing bar binding machine 1A will be described. The reinforcing bar binding machine 1A described above includes a main body portion 10A and a handle portion 11A.

Figure 1:
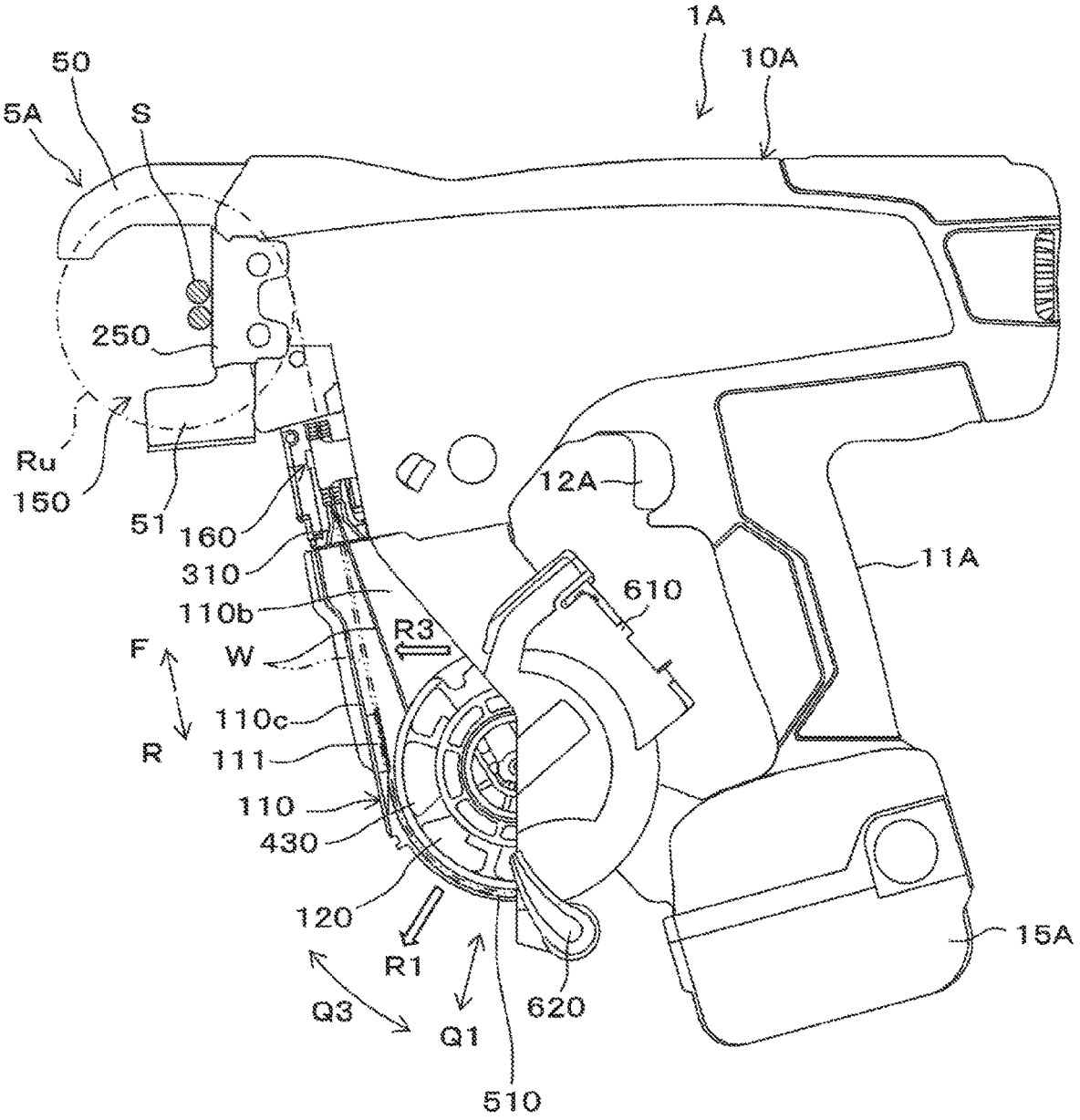
FIG. 1 is a partially cutaway side view of a binding machine according to an embodiment.

In the following description, the direction is based on a state (a state in which the reinforcing bar binding machine 1A is set up) of FIG. 1. A longitudinal direction (a direction corresponding to a left-right direction in FIG. 1) of the main body portion 10A is defined as a front-back direction and one predetermined direction (a direction corresponding to an up-down direction in FIG. 1) of the directions orthogonal to the longitudinal direction of the main body portion 10A is defined as an up-down direction (or a height direction). Further, a direction orthogonal to the front-rear direction and the up-down direction is defined as a left-right direction (or a width direction). One end side (a side facing the reinforcing bar S, the left side in FIG. 1) of the main body portion 10A in the longitudinal direction is defined as a front side or a tip end side and the other end side (a side opposite to the reinforcing bar S, the right side in FIG. 1) of the main body portion 10A in the longitudinal direction is defined as a rear side or a rear end side. Further, the upper side of FIG. 1 is referred to as an upper side with respect to the main body portion 10A and the lower side (a direction in which the handle portion 11A extends) of FIG. 1 is referred to as a lower side with respect to the main body portion 10A. The back side (the left side in FIG. 2) of the paper of FIG. 1 is the right side of the main body portion 10A and the front side (the right side in FIG. 2) of the paper of FIG. 1 is the left side of the main body portion 10A.

The handle portion 11A is provided so as to extend substantially downward from a substantially middle portion in the longitudinal direction of the main body portion 10A. A trigger 12A is provided on the handle portion 11A and a battery pack 15A can be attached to and detached from the lower portion. Then, by pulling the trigger 12A with a power switch (not illustrated) turned on, the reinforcing bar binding machine 1A is operated and a binding operation is performed.

Further, an accommodation portion 110 for setting a reel 120 around which the wire W used for binding the reinforcing bar S is wrapped is provided on the front side of the handle portion 11A. The reel 120 around which the wire W is wound is set in a detachable manner with respect to the accommodation portion 110.

Further, the main body portion 10A is provided with a wire feeding portion 160 for feeding the wire W wound around the reel 120 toward a binding portion 150 provided on the tip end side of the main body portion 10A. The wire feeding portion 160 is provided at the lower part on the tip end side of the main body portion 10A. The accommodation portion 110 is provided below the wire feeding portion 160.

Figure 2:
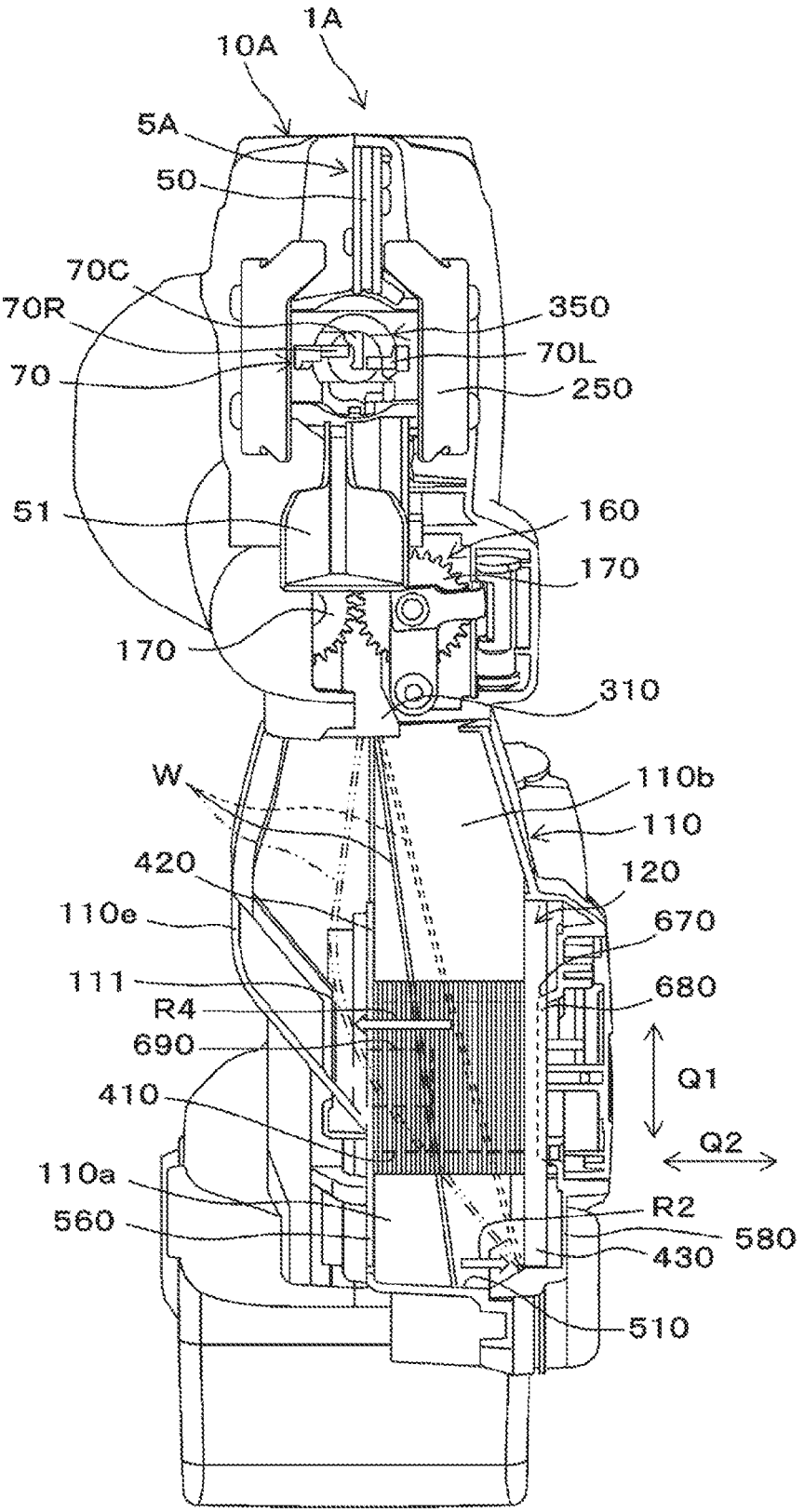
FIG. 2 is a front view of the binding machine of FIG. 1.
Figure 3:
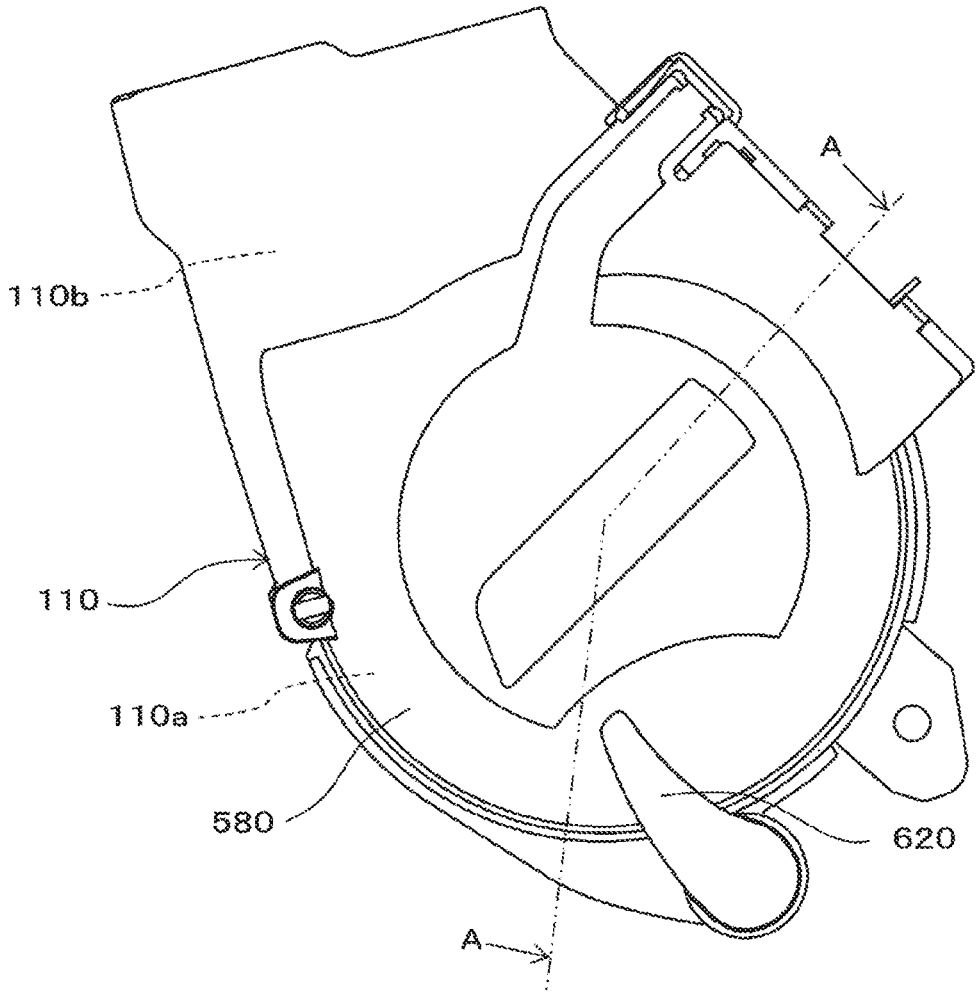
FIG. 3 is a side view of an accommodation portion.
Figure 4:
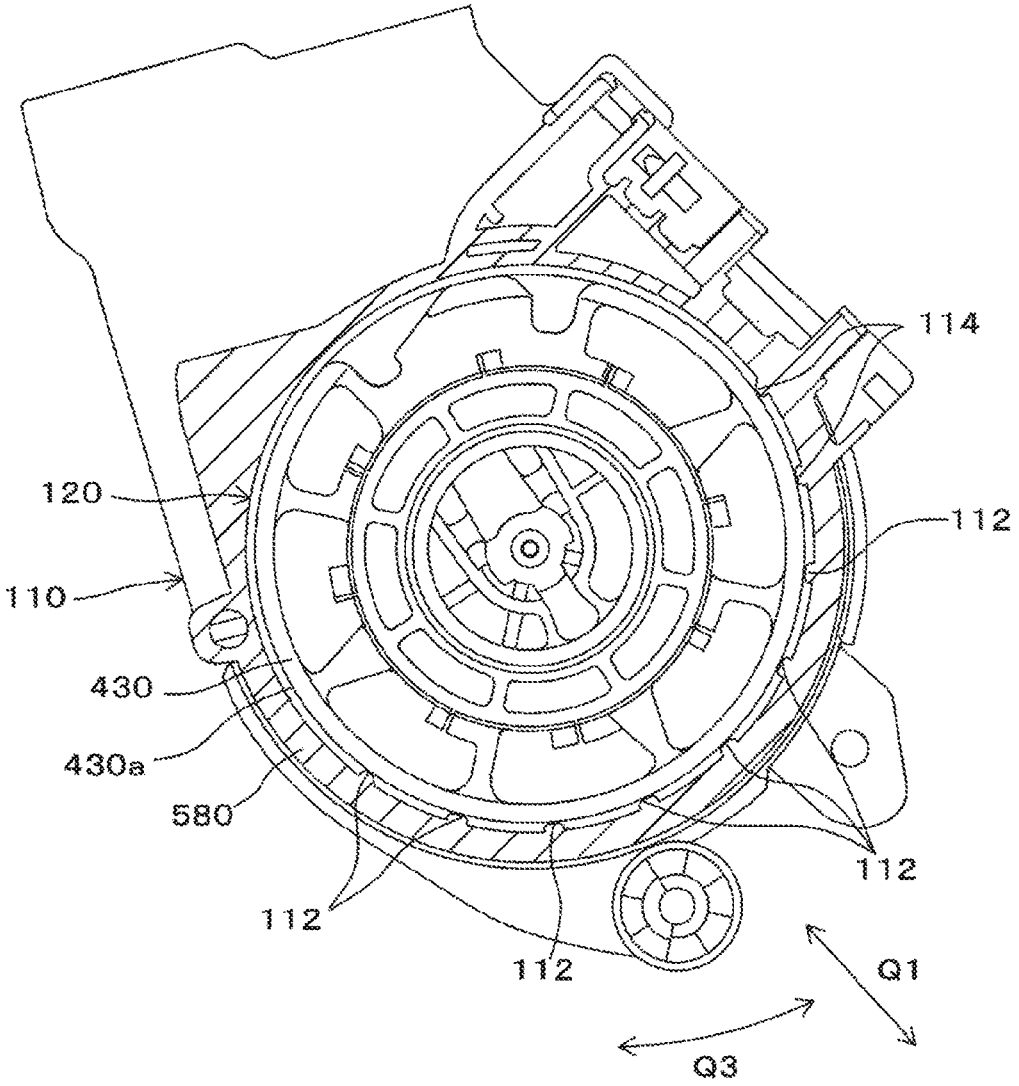
FIG. 4 is a side view illustrating an internal configuration of the accommodation portion.

As illustrated in FIG. 2, the wire feeding portion 160 includes feeding gears 170 which are a pair of feeding members for feeding the wire W, a feed motor (not illustrated) which rotationally drives one of the pair of feeding gears 170, and the like. The feeding gears 170 are provided in a pair, for example, so as to pinch the wire W from right and left. One of the pair of left and right feeding gears 170 is a driving wheel and the other is a driven wheel. The feeding gear 170 as a driven wheel is provided so as to be movable in a direction approaching and away from the feeding gear 170 as a drive wheel. Further, the feeding gear 170 as a driven wheel is pressed with a required pressing force in a direction approaching the feeding gear 170 as a driven wheel.

At the center in the thickness direction of the outer periphery of the feeding gear 170, a V-shaped feeding groove portion for receiving the wire W and frictionally driving is provided, forming a biting groove extending in a circumferential direction.

The wire feeding portion 160 can feed the wire W to the binding portion 150 by rotating the feeding gear 170 forward. Also, by reversing the feeding gear 170, the wire W can be pulled back from the binding portion 150 to the accommodation portion 110.

Further, the binding portion 150 is provided with an abutment portion 250 which can abut on the reinforcing bar S. Further, the binding portion 150 is provided with a curl guide portion 5A for turning the wire W fed by the wire feeding portion 160 into the loop Ru. The curl guide portion 5A has a first guide portion 50 and a second guide portion 51 provided in a pair above and below with the abutment portion 250 interposed therebetween.

The first guide portion 50 has a curling groove portion on its inner peripheral side for imparting an arc-shaped bending habit to the wire W. The second guide portion 51 has a groove on its inner peripheral side for receiving the wire W curled by the first guide portion 50. Then, the wire W is made to pass through the space between the first guide portion 50 and the second guide portion 51 in a counterclockwise direction in the drawing to form the loop Ru. Also, a portion between the first guide portion 50 and the second guide portion 51 is a passage portion for passing the reinforcing bar S toward the abutment portion 250.

Further, as illustrated in FIGS. 1 and 2, the main body portion 10A is provided with a wire guide 310 for guiding the wire W and regulating the position at least on an entry side of the wire feeding portion 160. Although not illustrated, wire guides are also provided at an exit side of the wire feeding portion 160 and at least the position of a base portion of the first guide portion 50. In a configuration in which two wires W are fed, the guide serves as a parallel guide for arranging the two wires W in parallel.

Although not illustrated, on the exit side of the wire feeding portion 160, a cutting portion is provided for separating the loop Ru portion of the wire W from other portions and has a fixed blade and a movable blade.

In addition, the abutment portions 250 on the tip end side of the main body portion 10A are located on both sides in the axial direction of the loop Ru of the wire W and are provided as a pair of left and right with a required interval. At the position between the left and right abutment portions 250 inside the main body portion 10A, there is provided a torsion portion 350 for tightening the wire W into the reinforcing bar S by twisting the wire W formed into the loop Ru. The torsion portion 350 includes a grip portion 70 capable of pinching, separating, and hooking the wire W and a drive mechanism (not illustrated) for rotating the grip portion 70 and the like.

As illustrated in FIG. 2, the grip portion 70 includes a fixed grip member 70C and a pair of left and right first movable grip member 70L and second movable grip member 70R. The grip portion 70 can form left and right wire passing portions for separately passing the overlapping portions of the wire W formed into the loop Ru.

Figure 6:
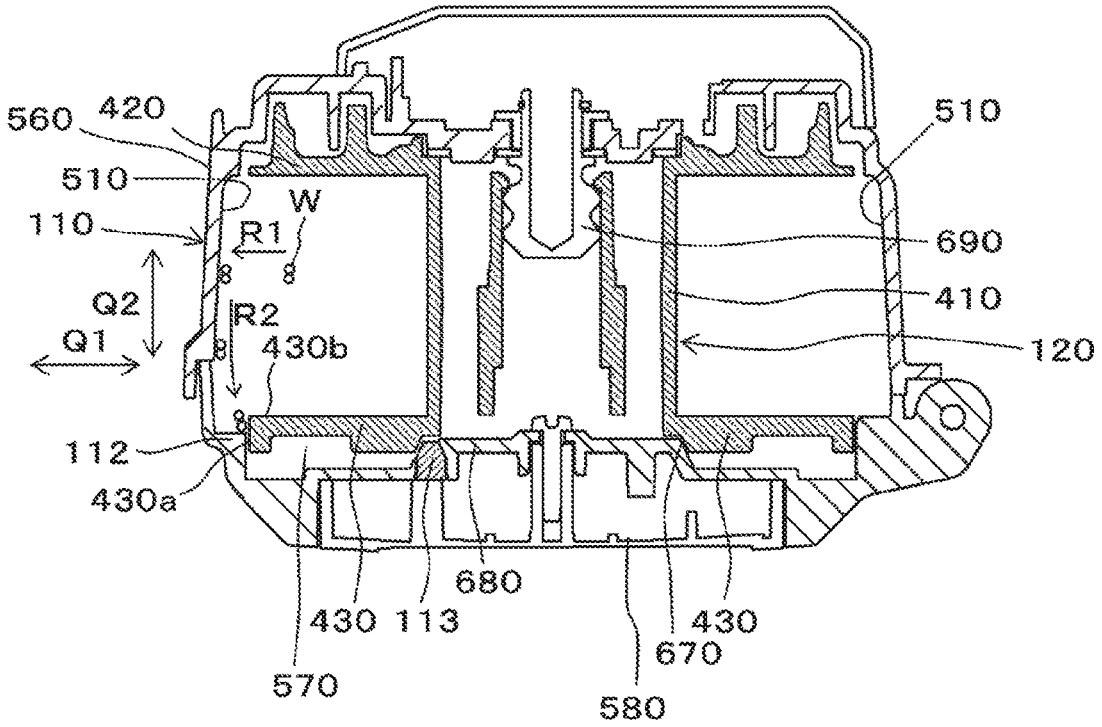
FIG. 6 is a cross-sectional view taken along the line A-A of FIG. 3, illustrating the internal configuration of the accommodation portion.
Figure 7A:
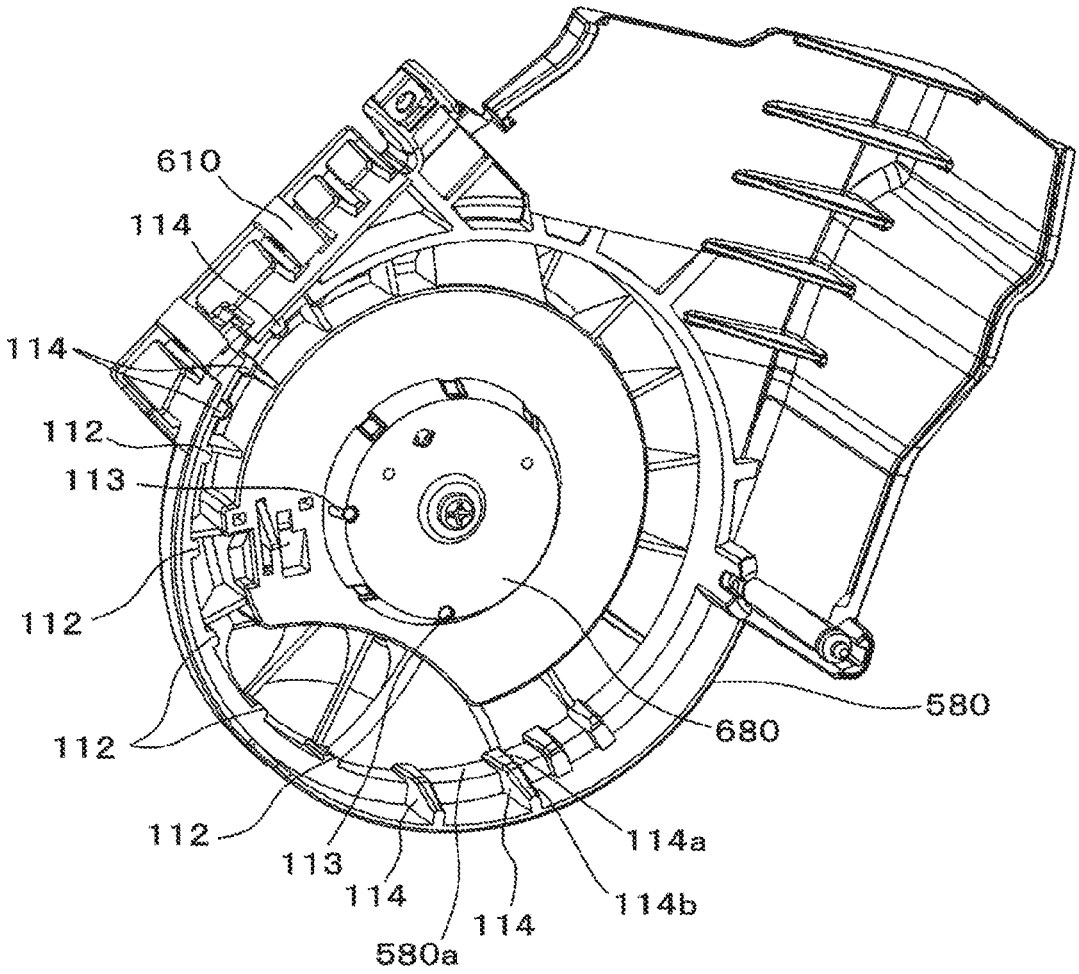
FIG. 7A is a perspective view of a cover of the accommodation portion as viewed from the back.
Figure 7B:
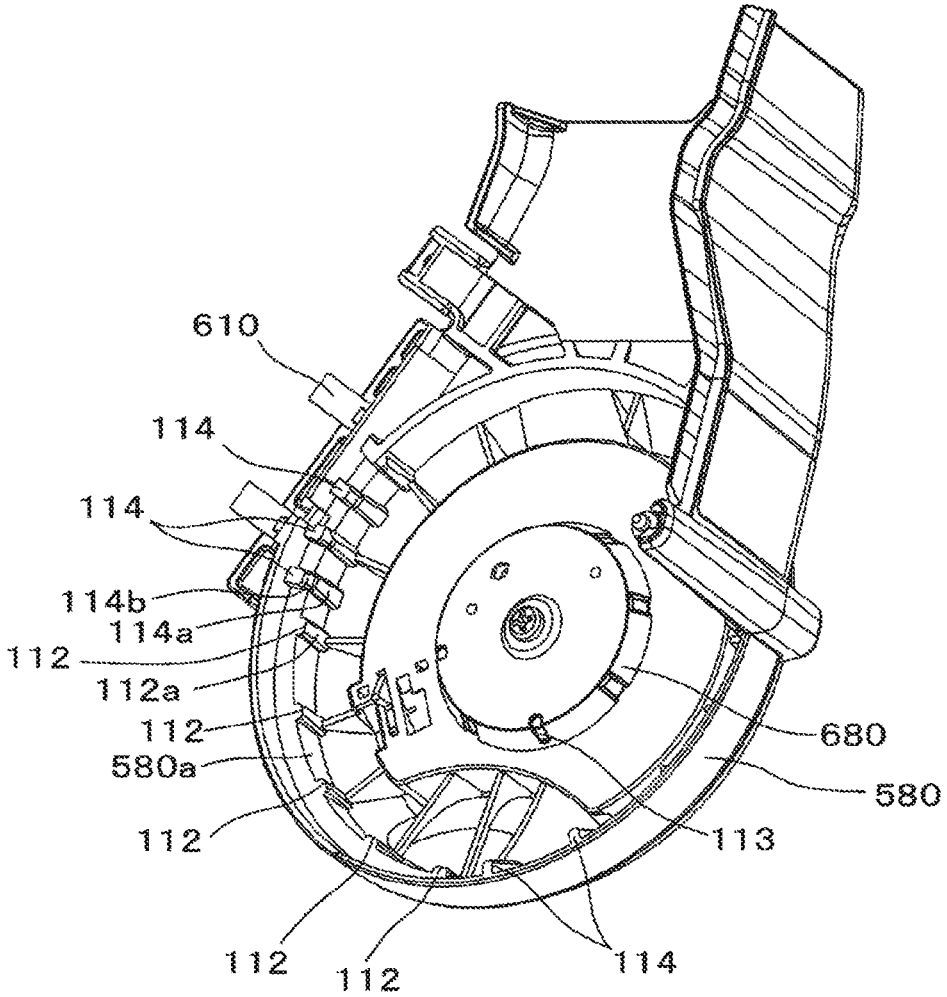
FIG. 7B is a perspective view of the cover of the accommodation portion as viewed from the back.

As illustrated in FIG. 6, the reel 120 includes a cylindrical hub portion 410 serving as a core of the wire W and a pair of flange portions 420 and 430 provided integrally on both end sides in the axial direction of the hub portion 410 or in the vicinities thereof. The flange portions 420 and 430 are formed in a substantially disc shape having a larger diameter than that of the hub portion 410 and are provided concentrically with the hub portion 410. The reel 120 is made of a resin such as ABS resin, polyethylene, or polypropylene. In the reel 120, one wire or two or more wires W are wound around the hub portion 410. For example, when two wires W are wound around the hub portion 410, two wires W can be pulled out from the reel 120 at the same time. The direction in which the reel 120 is attached to or detached from the accommodation portion 110 is the axial direction of the reel 120 along an axial direction of the hub portion 410.

The reel 120 is rotated following the withdrawal of the wire W from the reel 120 by the operation of feeding the wire W in a forward direction with the wire feeding portion 160. For this purpose, the accommodation portion 110 is provided with a first support portion 690 which is a support portion for supporting the flange portion 420 side of the hub portion 410 of the reel 120. Also, on the inner surface of a cover 580 which opens or closes the accommodation portion 110, a second support portion 680 is provided as a support portion for supporting the flange portion 430 side of the hub portion 410 of the reel 120 by entering a concave portion 670 provided on the outer surface of the flange portion 430 of the reel 120. The first support portion 690 is configured to allow rotation of the reel 120 in the operation of feeding the wire W in the forward direction and to restrict the rotation of the reel 120 in the operation of feeding the wire W in the opposite direction. The second support portion 680 is formed integrally with the cover 580.

When the reinforcing bar binding machine 1A has the orientation illustrated in FIG. 1, the wire W is pulled out substantially upward from the reel 120 by clockwise rotation (see FIG. 1) of the reel 120. In addition, the reel 120 is arranged in one of the left and right directions with respect to a width center position of the main body portion 10A and the wire feeding portion 160, and in this example, the reel 120 is offset to the left side of the apparatus so that a right-handed person can easily handle it (right side in FIG. 2). In particular, the reel 120 is completely offset laterally with respect to the first guide portion 50. However, the reel 120 may be offset from the main body portion 10A or the wire feeding portion 160 on the side opposite to the side described above. The width center position of the wire feeding portion 160 indicates a feed path of the wire W, and specifically, is a guide position of the wire W by the wire guide 310.

The accommodation portion 110 is formed of a case 560 capable of accommodating the reel 120 and a member such as the cover 580 capable of opening or closing an opening portion 570 for mounting the reel 120 provided in the case 560. In addition, the case 560 and the cover 580 are formed of a resin such as an ABS resin, polyethylene, or polypropylene.

The accommodation portion 110 is referred to as a magazine or the like and a reel accommodation portion 110*a* formed of at least a substantially cylindrical concave portion capable of accommodating the reel 120 is formed inside the case 560.

The accommodation portion 110 is provided with a wire passage 110*b* above the reel accommodation portion 110*a* for guiding the wire W drawn from the reel 120 to the wire guide 310 on the entry side of the wire feeding portion 160 (see FIGS. 1 and 2). The wire passage 110*b* is provided between the reel accommodation portion 110*a* and the wire feeding portion 160, more specifically, between the reel 120 accommodated in the accommodation portion 110 and the wire feeding portion 160. The wire passage 110*b* is integrally connected to the reel accommodation portion 110*a* to form a space through which the wire W can freely pass.

The opening portion 570 is provided on one side of the case 560, which is the offset side of the reel 120, in this example, on the left-side surface (right side in FIG. 2) of the apparatus.

The cover 580 is called a magazine cover or the like and has substantially the same shape as the opening portion 570 of the case 560. The cover 580 is attached to the case 560 so as to open or close around a hinge portion 610. The hinge portion 610 is provided at a position on the rear side of the accommodation portion 110. An urging spring which constantly urges the cover 580 in an opening direction with respect to the case 560 is interposed in the hinge portion 610.

A lock device 620 (see FIG. 1) for holding the cover 580 in a closed state is provided between the case 560 and the cover 580.

In contrast to the above basic or overall configuration, this embodiment has the following configuration.

In order to pull back the wire W and wrap it around the reinforcing bar S, as illustrated in FIG. 1, in the operation of feeding the wire W in the reverse direction indicated by the arrow R, since the reel 120 does not rotate, the wire W of the part wound around the reel 120 bends in a direction of spreading as indicated by an arrow R1 along a radial direction of the reel 120 indicated by an arrow Q1. The bent portion of the wire W is a portion provided on a part of the accommodation portion 110 which is the part on a side opposite to the side where the wire passage 110*b* is provided and comes into contact with an inner wall portion 510 along the circumferential direction of the reel 120 indicated by an arrow Q3.

As illustrated in FIG. 2, in a state where the bent portion of the wire W comes into contact with a part of the accommodation portion 110 which is the portion on a side opposite to the side where the wire passage 110*b* is provided with respect to the first support portion 690 and the second support portion 680, that is, the inner wall portion 510 on the opposite side to the side where the wire passage 110*b* is provided in the radial direction of the reel 120 indicated by the arrow Q1 in FIG. 2, when the wire W is further fed in the reverse direction indicated by the arrow R, the wire W moves laterally along the axial direction of the reel 120 indicated by an arrow Q2 as indicated by an arrow R2 in FIG. 2.

The lateral movement of the wire W became remarkable due to offsetting the reel 120 to one of the left and right directions with respect to the main body portion 10A and the wire feeding portion 160. When the wire W is fed in the reverse direction by the wire feeding portion 160, the wire W is directed to an offset direction of the reel 120 with respect to the wire feeding portion 160, that is, to the right in FIG. 2.

Also, when the wire W is further fed in the reverse direction in a state where the wire W is in contact with the inner wall portion 510, in the wire W, a portion between the portion pulled out from the reel 120 and the portion fed in the reverse direction by the wire feeding portion 160 moves in a direction of a front wall portion 110*c* of the wire passage 110*b* as illustrated by an arrow R3 in FIG. 1.

When the wire W comes in contact with the front wall portion 110*c* by feeding the wire Win the reverse direction and cannot move in the direction of the front wall portion 110*c*, the wire W bends in the lateral direction as illustrated by an arrow R4 in FIG. 2. In the wire passage 110*b*, a space for facilitating the work of manually loading the wire W into the wire feeding portion 160 is secured. As a result, the amount of bending of the wire W is increased by the operation of feeding the wire W in the opposite direction, and thus the wire W may be bent. As described above, in the wire W, the portion between the portion pulled out from the reel 120 and the portion interposed by the wire feeding portion 160 bends and the amount of bending increases and the wire W bends. This is referred to as buckling.

The direction in which the wire W bends is the other direction opposite to the offset direction of the reel 120, which is one direction, and is directed toward a left side wall portion 110*e* in FIG. 2. When the amount of bending of the wire W increases and the wire W is bent, entanglement or the like between the wires W is likely to occur and this causes a feed failure. In particular, in the configuration where two wires W are fed, the diameter of the wire W is small. Therefore, the order in which the wire W is wound is easily collapsed, for example, a state where the two wire W cross each other or a state where the two wire W are separated from each other. As a result, the wire W is easily entangled. Further, when the amount of bending of the wire W increases, the wire W in a portion in contact with the inner wall portion 510 further moves laterally in the offset direction of the reel 120 and the wire W that has moved in the lateral direction easily exceeds the flange portion 430 of the reel 120.

Therefore, the accommodation portion 110 includes a restricting portion 111 to reduce the amount of bending of the wire W. In a wire passage 110*b* between the reel 120 accommodated in the accommodation portion 110 and the wire feeding portion 160, the restricting portion 111 is provided on the side wall portion 110*e* in the other direction opposite to the one direction in which the reel 120 is offset.

The restricting portion 111 includes a restricting surface 111*a* which protrudes inward of the accommodation portion 110 and comes in contact with the wire W which is bent in the other direction opposite to the offset direction of the reel 120 along the axial direction of the reel 120 between the reel 120 and the wire feeding portion 160. The restricting portion 111 protrudes at a predetermined height from the front wall portion 110*c* in a direction crossing the offset direction of the reel 120 along the offset direction (one direction) of the reel 120 from the side wall portion 110*e*. In addition, the restricting portion 111 does not need to protrude from the side wall portion 110*e* as long as the restricting portion 111 has the restricting surface 111*a* with which the wire W bent in the other direction opposite to the offset direction of the reel 120 is in contact and it may protrude from the front wall portion 110*c* to the inside of the accommodation portion 110 in the direction crossing the offset direction of the reel 120.

The restricting portion 111 includes a restricting convex portion 111*b* for restricting the wire W in contact with the restricting surface 111*a* from coming off the restricting surface 111*a*. The restricting convex portion 111*b* has a protrusion protruding inward (in one direction) of the accommodation portion 110 and the wire passage 110*b* from the restricting surface 111*a* along the edge portion of the restricting surface 111*a* and the restricting surface 111*a* is formed in a concave shape along the direction in which the wire W is fed.

As described above, the accommodation portion 110 includes the case 560 in which the reel 120 is accommodated and the cover 580 provided to be openable or closable on the side (one direction side) in which the reel 120 is offset with respect to the case 560. The direction in which the wire W bends when the wire W is fed in the reverse direction is set as the opposite side (the other direction side) of the side where the wire W is offset. Therefore, the restricting portion 111 is provided in the case 560.

Also, as illustrated in FIGS. 4, 6, 7A, 7B, 8, and 9, the accommodation portion 110 includes a detachment restricting portion 112 which prevents the wire W that moves laterally in the axial direction of the reel 120 by the operation of feeding the wire W in the reverse direction from exceeding the flange portion 430 of the reel 120.

As described above, the wire W laterally moved by the operation of feeding the wire W in the reverse direction is directed to one direction which is the offset direction of the reel 120. For this reason, the detachment restricting portion 112 is provided in the cover 580 located in the direction in which the wire W moves in the lateral direction.

In the accommodation portion 110 with the case 560 closed with the cover 580, the detachment restricting portion 112 is provided at a position opposite to the flange portion 430 of the reel 120 accommodated in the accommodation portion 110 on the side opposite to the side where the wire passage 110*b* is provided with respect to the first support portion 690 and the second support portion 680. The disengagement restricting portions 112 are provided at a plurality of locations along the circumferential direction of the reel 120 at predetermined intervals in a range of about half a circumference in the circumferential direction of the reel 120 indicated by the arrow Q3.

The detachment restricting portion 112 is configured by a convex portion which protrudes from an inner peripheral surface 580*a* of the cover 580 along the radial direction of the reel 120 and includes a proximity portion 112*a* facing an outer peripheral surface 430*a* of the flange portion 430 of the reel 120.

In the detachment restricting portion 112, in a state where the flange portion 420 side of the hub portion 410 of the reel 120 is supported by the first support portion 690 and the second support portion 680 enters the concave portion 670 of the outer surface of the flange portion 430 of the reel 120, and further the flange portion 430 side of the hub portion 410 is supported by the second support portion 680, the height along the radial direction of the reel 120 is set so that the distance between the proximity portion 112*a* and the outer peripheral surface 430*a* of the flange portion 430 is less than the diameter of the wire W and the proximity portion 112*a* does not come in contact with the flange portion 430.

Further, the height of the detachment restricting portion 112 along the axial direction of the reel 120 is set so as not to exceed an inner surface 430*b* of the flange portion 430.

Further, as illustrated in FIGS. 7A, 7B, 8, and 9, the accommodation portion 110 includes a guide portion 114 which guides the reel 120 accommodated in the accommodation portion 110. The guide portion 114 is provided on a side of the cover 580 where the hinge portion 610 is provided. Further, in the cover 580, the guide portion 114 may be provided on the side opposite to the side where the hinge portion 610 is provided with respect to the second support portion 680.

The guide portion 114 is configured by a convex portion which protrudes from the inner peripheral surface 580*a* of the cover 580 along the radial direction and the axial direction of the reel 120. The guide portion 114 includes a proximity portion 114*a* facing the outer peripheral surface 430*a* of the flange portion 430 of the reel 120. The guide portion 114 includes a slope 114*b* which is formed of a surface that is continuous from the proximity portion 114*a* and guides the reel 120 toward the proximity portion 114*a* when the flange portion 430 of the reel 120 comes in contact therewith.

In a state where the flange portion 420 side of the hub portion 410 of the reel 120 is supported by the first support portion 690 and the flange portion 430 side of the hub portion 410 of the reel 120 is supported by the second support portion 680, the guide portion 114 is set to have a height along the radial direction of the reel 120 so that the distance between the proximity portion 114*a* and the outer peripheral surface 430*a* of the flange portion 430 is smaller than the diameter of the wire W and the proximity portion 114*a* does not come in contact with the flange portion 430.

As illustrated in FIGS. 6, 7A, 7B, and 8, the accommodation portion 110 includes a hard member 113 which suppresses wear of the second support portion 680 provided on the cover 580. The hard member 113 is made of, for example, a metal rod-shaped member which is harder and has higher wear resistance than the resin which forms the cover 580.

The hard members 113 are provided at a plurality of predetermined locations along the circumferential direction of the second support portion 680 so as to be exposed on the outer periphery of the second support portion 680. The position where the hard member 113 is provided is a side far from the wire passage 110*b*. That is, the hard member 113 is provided on the opposite side of the wire passage 110*b* with respect to the center of the second support portion 680. This is because, in the operation of feeding the wire W in the forward direction, a portion where the reel 120 slides with respect to the second support portion 680 is mainly a portion far from the wire passage 110*b*. The hard member 113 may be a plate-shaped metal other than a rod-shaped metal or may be a metal roller rotatable along the sliding direction of the reel 120.

<Operation>

Next, an operation of binding the reinforcing bar S with two wires W by the reinforcing bar binding machine 1A of the embodiment will be described with reference to the drawings.

In the reinforcing bar binding machine 1A, when the wire W is pinched between the pair of feeding gears 170 and the trigger 12A is operated, the feeding gear 170 rotates in the forward direction and the two wires W are fed in the forward direction indicated by the arrow F.

The wire W fed in the forward direction passes through a portion between the first movable grip member 70L and the fixed grip member 70C and has a curl along the periphery of the reinforcing bar S by passing through the curl guide portion 5A. The wire W having the curl added by the first guide portion 50 is guided to a portion between the second movable grip member 70R and the fixed grip member 70C by the second guide portion 51. When the end portion of the wire W is fed to a predetermined position, the loop Ru is formed.

After the feed of the wire W is stopped, the grip portion 70 is operated and the first movable grip member 70L and the second movable grip member 70R are moved in the direction of the fixed grip member 70C, and then the end portion of the wire W is gripped. When the wire W is gripped by the grip portion 70, the feeding gear 170 is rotated in the reverse direction and the wire W is fed in the reverse direction indicated by the arrow R. In the operation of feeding the wire W in the reverse direction, the wire W is wrapped so as to be in close contact with the reinforcing bar S.

After wrapping the wire W around the reinforcing bar S and stopping the feeding of the wire W, the wire W is cut by a cutting unit (not illustrated). After cutting the wire W, the end portion of the wire W is bent to the reinforcing bar S side. Then, the grip portion 70 gripping the wire W is rotated and the wire W is twisted. After twisting the wire W, the first movable grip member 70L and the second movable grip member 70R are moved away from the fixed grip member 70C to release the grip of the wire W.

<Effect>

According to the embodiment, the following effects can be obtained for the problems of the related art.

As described above, in order to pull back the wire W and wrap it around the reinforcing bar S, in the operation of feeding the wire W in the reverse direction indicated by the arrow R, the reel 120 does not rotate. Therefore, the wire W of the portion wound around the reel 120 bends in the direction of spreading as indicated by the arrow R1 along the radial direction of the reel 120 indicated by the arrow Q1. Further, the bent portion of the wire W comes in contact with the inner wall portion 510 on the opposite side of the accommodation portion 110 from the side where the wire passage 110*b* is provided with respect to the first support portion 690 and the second support portion 680.

When the bent portion of the wire W is in contact with the inner wall portion 510 and the wire W is further fed in the opposite direction indicated by the arrow R, the wire W moves laterally along the axial direction of the reel 120 indicated by the arrow Q2 in one direction which is the offset direction of the reel 120 as indicated by the arrow R2 in FIG. 2.

When the wire W is further fed in the reverse direction in a state where the wire W is in contact with the inner wall portion 510, in the wire W, the portion between the portion pulled out from the reel 120 and the portion pinched by the wire feeding portion 160 moves in the direction of the front wall portion 110*c* of the wire passage 110*b* as illustrated by the arrow R3 in FIG. 1. Furthermore, as illustrated by an arrow R4 in FIG. 2, it bends in the direction of the side wall portion 110*e* in the other direction (the direction opposite to the offset direction).

In the operation for feeding the wire W in the reverse direction, when a portion between the portion of the wire W drawn out from the reel 120 and the portion pinched by the wire feeding portion 160 bends in the direction of the side wall portion 110*e*, the wire W comes into contact with the restricting portion 111.

Figure 5:
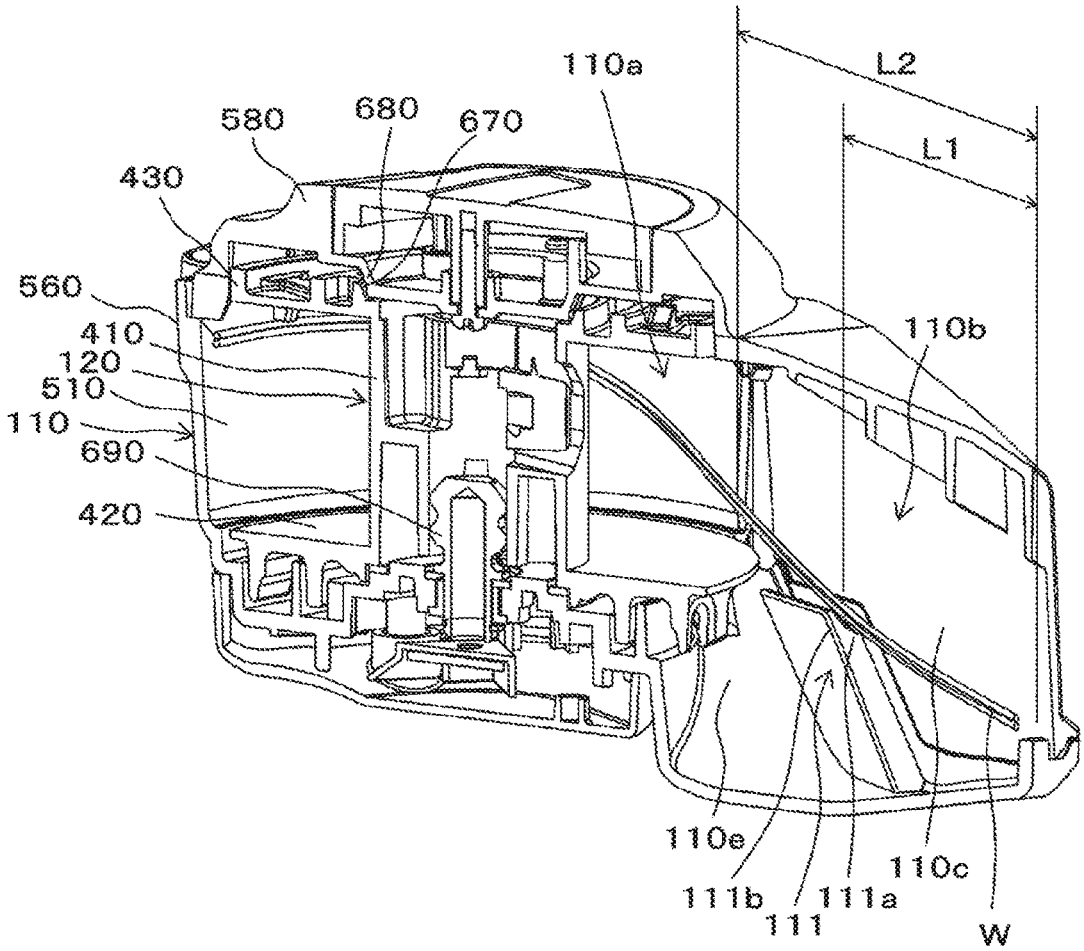
FIG. 5 is a cutaway perspective view illustrating the internal configuration of the accommodation portion.

In FIG. 5, L1 and L2 indicate the length between the fulcrums when the wire W moves in the direction opposite to the offset direction and comes into contact with the side wall portion 110*e* and the like. L1 indicates the fulcrum length when the restricting portion 111 is provided and L2 indicates the fulcrum length when the restricting portion 111 is not provided.

Since the buckling load required to buckle the wire W is inversely proportional to the square of the fulcrum length, buckling becomes difficult to occur by shortening the fulcrum length. As illustrated in FIG. 5, by providing the restricting portion 111, the wire W moves in the direction opposite to the offset direction and comes into contact with the restricting portion 111. Therefore, the restricting portion 111 serves as a fulcrum for supporting the wire W and the fulcrum length becomes shorter than that in a case where there is no restricting portion.

Thereby, when a force for bending the wire W is applied, the wire W becomes difficult to bend and the wire W is prevented from bending in the direction of the side wall portion 110*e*. Therefore, the amount of bending of the wire W is reduced, and thus the occurrence of buckling is suppressed.

Also, the restricting portion 111 includes the restricting convex portion 111*b* in order to restrict the wire W in contact with the restricting surface 111*a* from coming off the restricting surface 111*a*. Therefore, the restricting surface 111*a* has a concave shape and the wire W in contact with the restricting surface 111*a* is prevented from bending beyond the restricting portion 111 in the direction of the side wall portion 110*e*, so that the amount of bending is reduced.

Since the amount of bending of the wire W is reduced, it is possible to suppress the wires W from being entangled with each other and to suppress occurrence of wire feeding failure. In particular, in the configuration in which two wires W are fed, the order in which the wire W is wound is suppressed from being disrupted, such as a state where the two wire W cross each other or a state where the two wire W are separated from each other, and the entanglement of the wires W is suppressed.

Then, by reducing the amount of bending of the wire W, the wire W at a portion in contact with the inner wall portion 510 is suppressed from further laterally moving in the offset direction of the reel 120, and thus the wire W that has moved in the lateral direction is unlikely to exceed the flange portion 430 of the reel 120.

As described above, the restricting portion 111 is provided with the restricting convex portion 111*b* on the restricting surface 111*a*, so that the wire Win contact with the restricting surface 111*a* is restricted from coming off the restricting surface 111*a*. When the restricting portion 111 having such a shape is provided on the cover 580, when the cover 580 is opened, the wire W is caught on the restricting convex portion 111*b* of the restricting portion 111 and this makes it difficult to open the cover 580.

Therefore, the cover 580 which can be opened or closed is provided on the side where the reel 120 is offset and the restricting portion 111 is provided in the case 560 on the opposite side to the side where the wire W is offset, which is the direction in which the wire W is bent by being fed in the reverse direction. This suppresses the opening or closing of the cover 580 from being hindered by the restricting portion 111.

Further, the accommodation portion 110 includes the detachment restricting portion 112 which suppresses the wire W moved laterally from exceeding the flange portion 430 of the reel 120. In the operation of feeding the wire W in the reverse direction indicated by the arrow R, as illustrated in FIG. 6, the wire W of the part wound around the reel 120 bends in the direction of spreading as indicated by the arrow R1 along the radial direction of the reel 120 indicated by the arrow Q1 and the bent portion of the wire W comes in contact with the inner wall portion 510 on the opposite side of the accommodation portion 110 from the side where the wire passage 110*b* is provided with respect to the first support portion 690 and the second support portion 680 illustrated in FIG. 2.

When the bent portion of the wire W is in contact with the inner wall portion 510 as illustrated in FIG. 6 and the wire W is further fed in the reverse direction, the wire W moves laterally along the axial direction of the reel 120 indicated by the arrow Q2 in the direction of the flange portion 430 of the reel 120 as indicated by the arrow R2 in FIG. 6.

Figure 8:
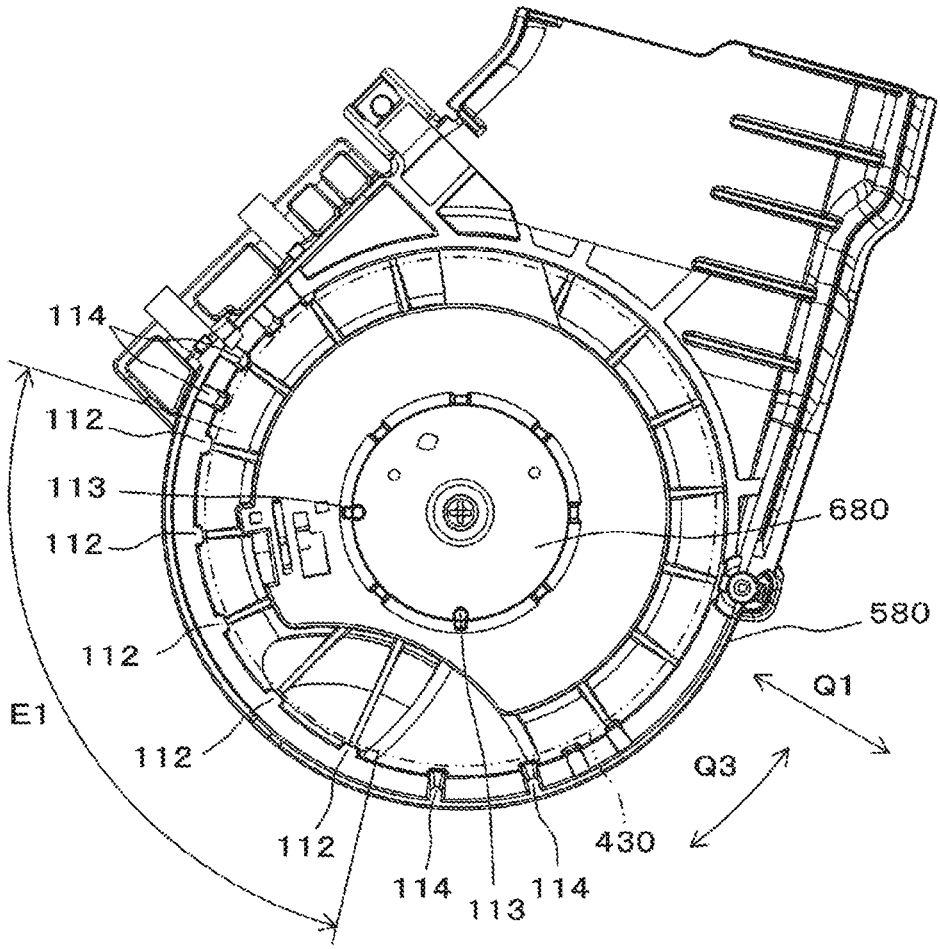
FIG. 8 is a plan view of the cover of the accommodation portion as viewed from the back.
Figure 9:
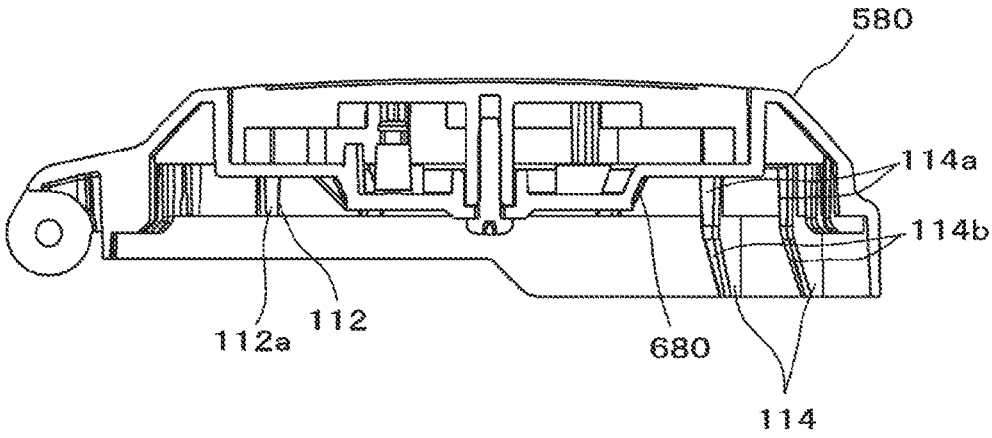
FIG. 9 is a cross-sectional view of the cover of the accommodation portion.

Therefore, the wire W easily exceeds the flange portion 430 in a range E1 illustrated in FIG. 8 on the side opposite to the side where the wire passage 110*b* is provided with respect to the first support portion 690 and the second support portion 680.

The detachment restricting portion 112 is provided on the opposite side to the side where the wire passage 110*b* is provided with respect to the first support portion 690 and the second support portion 680 and is provided in a range of about half a circumference in the circumferential direction of the reel 120. In the detachment restricting portion 112, the proximity portion 112*a* faces the outer peripheral surface 430*a* of the flange portion 430. The detachment restricting portion 112 is configured such that the distance between the proximity portion 112*a* and the outer peripheral surface 430*a* of the flange portion 430 is set to be smaller than the diameter of the wire W. Therefore, the wire W which has moved in the lateral direction is prevented from exceeding the flange portion 430 of the reel 120.

The height of the detachment restricting portion 112 along the radial direction of the reel 120 is set so that the proximity portion 112*a* does not come in contact with the flange portion 430. However, there is a possibility that the detachment restricting portion 112 and the flange portion 430 may come into contact with each other due to backlash due to a dimensional error between the reel 120 and the cover 580.

When the detachment restricting portion 112 and the flange portion 430 come into contact with each other in the operation of feeding the wire W in the forward direction, the rotation of the reel 120 driven by the feeding of the wire W is hindered. When the detachment restricting portion 112 is provided in a continuous form in the circumferential direction of the reel 120, when the detachment restricting portion 112 and the flange portion 430 come into contact with each other, the resistance increases, and thus the rotation of the reel 120 is further hindered.

In the operation of feeding the wire W in the forward direction, when the rotation of the reel 120 is hindered, there is a possibility that the wire W of the portion pulled out from the reel 120 may be in a state called a bite between the wires W of the portion wound around the reel 120.

Therefore, the detachment restricting portions 112 are not provided on the wire passage 110*b* side with respect to the first support portion 690 and the second support portion 680, in which the wire W is unlikely to come off the flange portion 430. Also, the detachment restricting portions 112 are provided at a plurality of locations along the circumferential direction of the reel 120 at predetermined intervals in a range of about half a circumference in the circumferential direction of the reel 120. Thus, even when the detachment restricting portion 112 and the flange portion 430 come into contact with each other, the rotation of the reel 120 is prevented from being hindered, and the biting of the wire W is suppressed.

Also, the reel 120 is supported by the cover 580 when the second support portion 680 provided in the cover 580 enters the concave portion 670. When the second support portion 680 wears due to the rotation of the reel 120, the distance between the detachment restricting portion 112 and the flange portion 430 is widened and the wire W may be interposed between the detachment restricting portion 112 and the flange portion 430.

Therefore, the hard member 113 is provided in the second support portion 680 of the cover 580. In the operation of feeding the wire W in the forward direction, by providing the hard member 113 in the second support portion 680 on the far side with respect to the wire passage 110*b* where the reel 120 slides with respect to the second support portion 680, the wear of the second support portion 680 is suppressed. As a result, the distance between the detachment restricting portion 112 and the flange portion 430 can be maintained.

To accommodate the reel 120 in the accommodation portion 110, the cover 580 is opened and the hub portion 410 of the reel 120 is inserted into the first support portion 690. When the cover 580 is opened in a state where the hub portion 410 of the reel 120 is supported by the first support portion 690, the position of a part of the reel 120 which is the part not supported by the first support portion 690 is shifted by the weight of the reel 120.

When the cover 580 is closed in such a state, in the accommodation portion 110, the slope 114*b* of the guide portion 114 located on the hinge portion 610 side comes into contact with the outer peripheral surface 430*a* of the flange portion 430 of the reel 120, which is located on the hinge portion 610 side. Then, by further closing the cover 580, the flange portion 430 of the reel 120 is guided by the slope 114*b* toward the proximity portion 114*a*. As a result, the radial position of the reel 120 is adjusted and the second support portion 680 of the cover 580 enters the concave portion 670 of the reel 120. In a configuration in which the guide portion 114 is also provided on the opposite side to the side where, in the cover portion 580, the hinge portion 610 is provided with respect to the second support portion 680, at an end step of the operation for closing the cover 580, the slope 114*b* of the guide portion 114 located on the opposite side to the side where the hinge portion 610 is provided may come into contact with the outer peripheral surface 430*a* of the flange portion 430 of the reel 120, which is located on the side opposite to the side where the hinge portion 610 is located in the accommodation portion 110. As a result, the radial position of the reel 120 is adjusted.

In this way, by the operation for closing the cover 580, the radial position of the reel 120 is guided by the guide portion 114 provided on the cover 580 such that the concave portion 670 provided on the flange portion 430 of the reel 120 enters the second support portion 680 provided on the cover 580.

Figure 10:
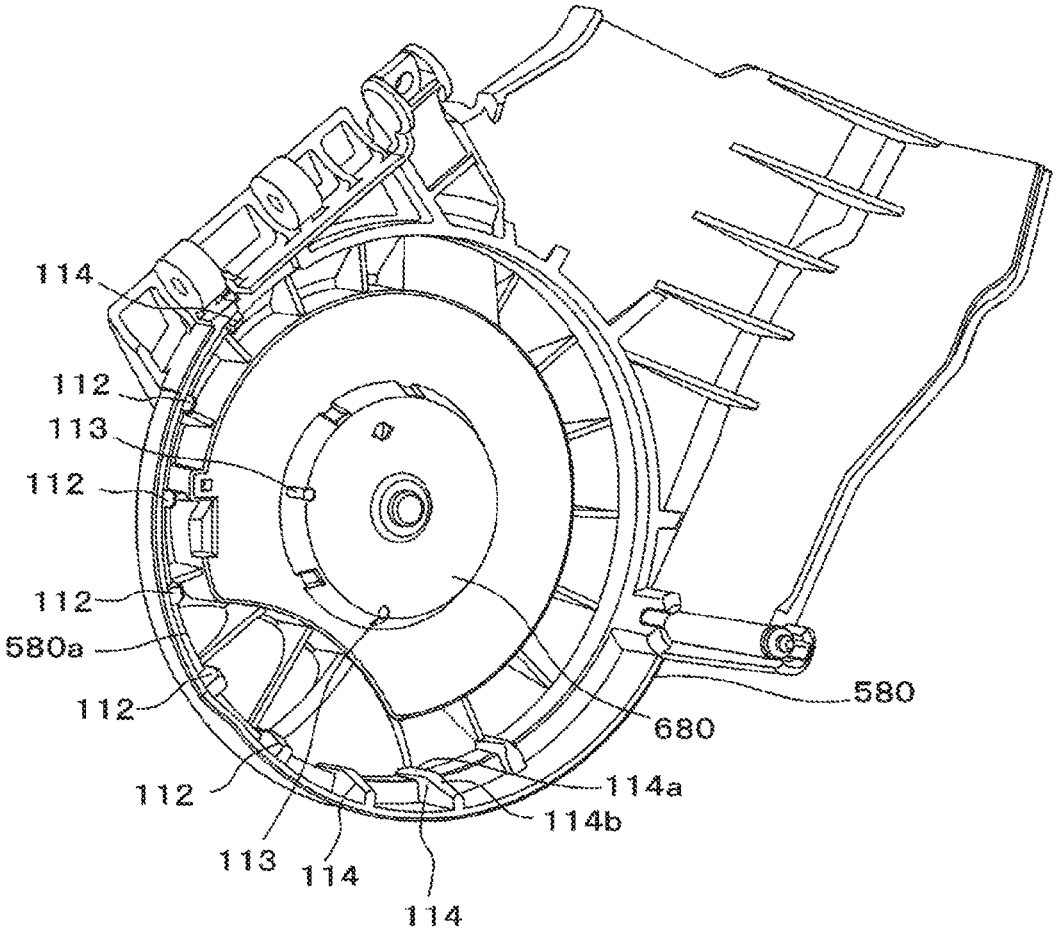
FIG. 10 is a perspective view of the cover of the accommodation portion as viewed from the back.

As illustrated in FIG. 10, as similar to the guide portion 114, the detachment restricting portion 112 may be configured by a convex portion which protrudes from the inner peripheral surface 580*a* of the cover 580 along the radial direction and the axial direction of the reel 120.

The invention claimed is:

1. A binding machine, comprising:

an accommodation portion accommodating a reel around which a wire is wound;

a wire feeding portion configured to feed the wire wound around the reel in a forward direction, winds the wire around a binding object, feeds the wire wound around the binding object in a reverse direction, and wraps the wire around the binding object; and a torsion portion configured to twist the wire, wherein the accommodation portion accommodates the reel in such a manner that the reel is offset with respect to the wire feeding portion in one direction along an axis of rotation of the reel when the reel is rotated by the wire being fed, the binding machine further comprising a restricting portion located in a wire passage between the reel accommodated in the accommodation portion and the wire feeding portion, the restricting portion protruding inward of the accommodation portion to restrict bending of the wire in the wire passage in a direction opposite to the direction the reel is offset and having a restricting surface which comes in contact with the wire when the wire is bent in the direction opposite to the direction the reel is offset, wherein the restricting surface is concave in the direction opposite to the direction the reel is offset, and the restricting portion further includes a restricting convex portion provided along the restricting surface, the restricting convex portion protruding in the direction of the reel offset from the restricting surface to restrict the wire from coming off the restricting surface in a direction toward the reel.

2. The binding machine according to claim 1, wherein the restricting portion protrudes from a side wall opposite to a side where the reel is offset along an offset direction of the reel.

3. The binding machine according to claim 1, wherein the restricting portion protrudes from a front wall portion of the accommodation portion in a direction intersecting an offset direction of the reel.

4. The binding machine according to claim 1, wherein the accommodation portion includes a case in which the reel is accommodated and a cover which is openable and provided on a side where the reel is offset with respect to the case, and the restricting portion is provided in the case.

5. The binding machine according to claim 1, wherein the accommodation portion includes a support portion capable of supporting the reel, and detachment restricting portions protruding along a radial direction of the reel at positions facing a peripheral surface of one flange portion of the reel located on a side where the reel is offset, which is opposite to a side where the wire passage is provided with respect to the support portion, and the detachment restricting portions are provided at a plurality of locations along a circumferential direction of the reel at intervals.

6. The binding machine according to claim 1, wherein the accommodation portion includes a cover which opens and closes the accommodation portion and has a support portion capable of supporting the reel, and the cover has a hard member which is exposed to an outer periphery of the support portion and is harder than the support portion.

7. The binding machine according to claim 6, wherein the hard member is made of metal.

8. The binding machine according to claim 1, wherein the wire includes two or more wires which are wound around the reel and are capable of being pulled out.

* * * * *